United States Patent [19]

Forgione

[11] 4,059,413

[45] Nov. 22, 1977

[54] WINDOW SECURITY APPARATUS

[76] Inventor: Joseph Forgione, 6145 Highway 51 North, Millington, Tenn. 38053

[21] Appl. No.: 693,214

[22] Filed: June 4, 1976

[51] Int. Cl.[2] ..... E06B 3/68

[52] U.S. Cl. ..... 49/56

[58] Field of Search ..... 49/56, 57

[56] References Cited

U.S. PATENT DOCUMENTS

| | | | |
|---|---|---|---|
| 1,110,678 | 9/1914 | Franklin | 49/57 |
| 1,634,842 | 7/1927 | McWane | 49/56 X |
| 2,195,291 | 3/1940 | Zukor | 49/56 |

*Primary Examiner*—Kenneth Downey
*Attorney, Agent, or Firm*—John R. Walker, III

[57] ABSTRACT

Security apparatus for attachment to the interior side of conventional residential window structure and which includes a horizontal bar having a plurality of vertical bars fixedly attached thereto. The vertical bars are slidably received in respective apertures suitably provided in the sill of the window, thus the bars may be slidably moved upwardly to a security position which occludes the window and downwardly to an escape position which unobstructs the window. Lock structure is included to lock the bars in the security position and a lock trip/release device makes provisions for releasing the lock structure which causes the bars to gravitate downwardly to the escape position thus enabling occupants of the building to escape outwardly through the window in the event of fire and the like.

10 Claims, 7 Drawing Figures

WINDOW SECURITY APPARATUS

BACKGROUND OF THE INVENTION

1. Field of the Invention

This invention relates to the field of movable guard structure for windows and is particularly directed toward guard structure which may be moved independently from the sash structure of the window.

2. Description of the Prior Art

Heretofore, typical movable guard structure for conventional residential windows was of the type which provided security when the windows were open and moved either upwardly with the upper sash or downwardly with the lower sash into the void air space between the inner and outer walls of the structure so as to be totally unobscured when the windows were closed, i.e., coming into play only when the windows were opened thus providing a degree of security only when the windows were open.

Applicant is aware of other movable window guard structure which is mounted on hinges so as to swing about a vertical axis when it is desired that the window be unobstructed for various reasons such as cleaning the window or for providing an escape in the even of fire and the like. This latter type of swingable guard includes conventional lock structure for selectively locking the guard in the secure position. A serious problem exists with this type window guard in that the concept is to place the key a given distance away from the window so that an intruder is not able to break the window and reach the key for unlocking the window guard. However, many people have lost their lives in their residence with this type window guard and evidence strongly points to the belief that the frustration and shock precludes clear thinking on the part of the victim which prevents him from either locating the key or going through the mechanical process of unlocking the window guard to establish an escape route.

It should also be pointed out that the former mentioned window guard structure which moves up and down with the sash does not enable occupants of the building to escape outwardly through the window in the event of fire and the like, i.e., raising the sash to provide an open window automatically carries the guard structure upwardly across the opening thus obstructing the opening as the sash is lifted.

SUMMARY OF THE INVENTION

The present invention is directed towards overcoming the disadvantages and problems relative to previous window guard structure, particularly the problem in which the window guard structure prevents the establishment of an escape route by the occupants of the building in the event of fire and the like.

The concept of the present invention is to provide window security apparatus which is adaptable to the interior side of existing conventional residential window structure or it may be incorporated with the window structure at the time of fabrication thereof for subsequent installation in new construction. The window security apparatus of the present invention includes a horizontal bar having a plurality of vertical bars fixedly attached thereto. The vertical bars are slidably received in respective apertures suitably provided in the sill of the window, thus, the bars may be slidably moved upward to a security position which occludes the window and downwardly to an escape position which unobstructs the window. Track structure preferably is included which is attached to either side of the window casing for engaging and guidingly constraining the horizontally disposed bar in the travel thereof between the up and down positions. Lock structure is also included to lock the bars in the security position and a lock trip/release device makes provisions for releasing the lock structure which enables the bars to be free to gravitate downwardly to the escape position thus enabling occupants of the building to escape outwardly through the window in the event of fire or the like. The lock structure of the present invention preferably is of the type which does not require a removable key for the actuation or unlocking action thereof. On the other hand, the lock structure of the present invention is constructed in such a manner as to deny access thereto by an intruder.

DESCRIPTION OF THE PREFERRED EMBODIMENT

Figure 1:
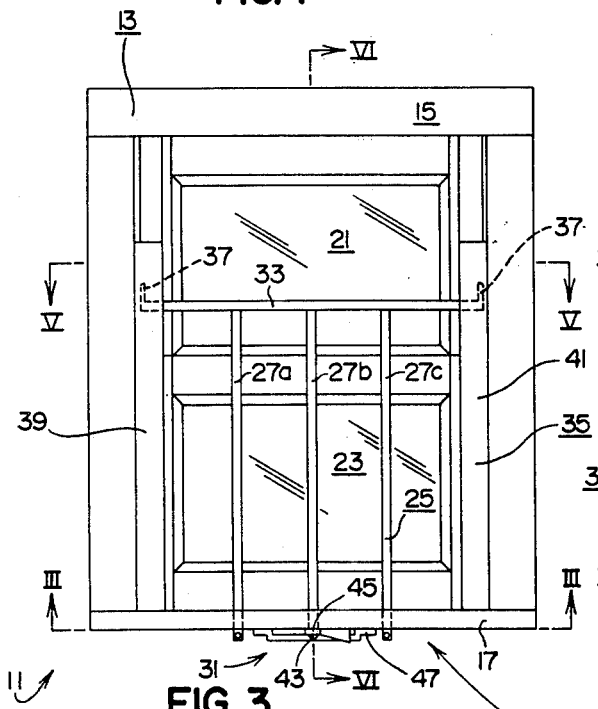
FIG. 1 is a side elevational view of a conventional residential window having the window security apparatus of the present invention incorporated therewith and shown in the upward or security position.

The window security apparatus 11 of the present invention is preferably intended to be used in combination with residential and such window structure which is character referenced in the drawing by the numeral 13. Typical window structure 13 generally includes a frame member 15 defined in part by a horizontal sill element 17 and a pair of vertical confrontingly arranged casing elements 19. It should be understood that the frame member 15 includes various other structural elements well known to those skilled in the art but have no significance in combination with the present invention, therefore, it is deemed to be unnecessary to further expound thereon. However, it should be mentioned that the window structure 13 also includes the usual upper and lower sash members 21, 23 which incorporate window locking structure well known to those skilled in the art and not shown in the drawing.

Figure 6:
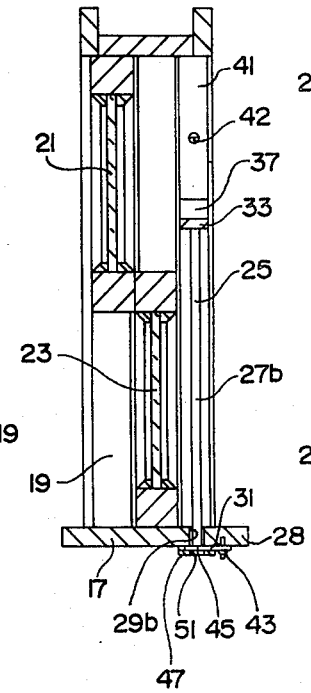
FIG. 6 is a sectional view taken as on the line VI—VI of FIG. 1.
Figure 7:
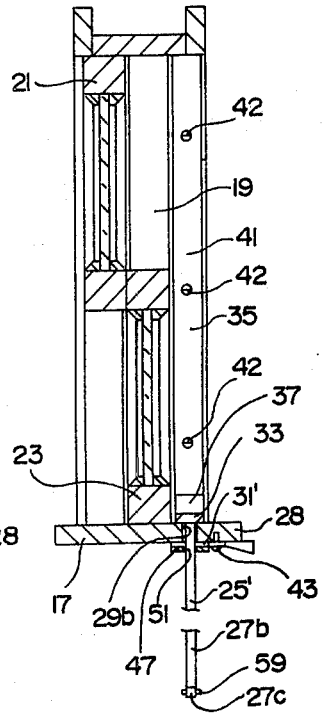
FIG. 7 is a sectional view taken as on the line VII—VII of FIG. 2.

The window security apparatus 11 of the present invention is intended to be attached to the frame structure 15 for minimizing the likelihood of intrusion through the window while enabling occupants of the residence to rapidly escape outwardly therethrough in the event of fire and the like. The window security apparatus 11 generally includes guard means 25 for providing a security barrier against intrusion into the residence. The guard means 25 is preferably formed of metal and includes a plurality of vertical bar members 27 which are individually designated as **27*a*, 27*b*, 27*c*, etc., disposed on the interior side 28** of the window structure 13 as clearly shown in FIGS. 6 and 7 of the drawing. The sill element 17 is provided with a plurality of apertures 29 which are individually designated as *29a, 29b, 29c,* etc., for respectively slidably receiving the plurality of vertical bar members 27. The guard means 25 is free to be slidably moved up and down independently from any of the window structure 13 with the movement thereof being between a windown occluded or security positions, as clearly shown in FIG. 1 of the drawing and characterized therein merely by the numeral 25, and a window unobstrucuted or escape position, as clearly shown in FIG. 2 of the drawing and characterized by the numeral 25'.

Figure 3:
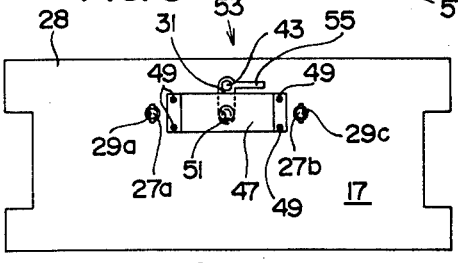
FIG. 3 is a view taken as on the line III—III of FIG. 1.
Figure 4:
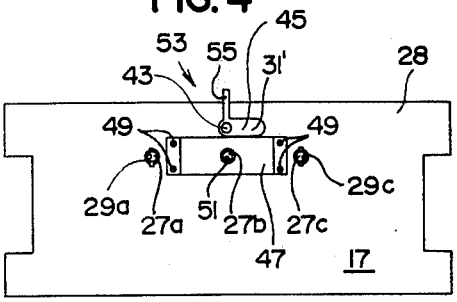
FIG. 4 is a view taken as on the line IV—IV of FIG. 2.
Figure 5:
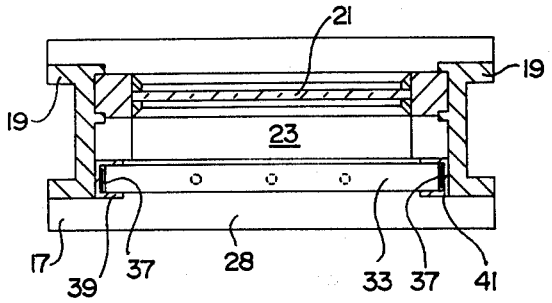
FIG. 5 is a sectional view taken as on the line V—V of FIG. 1.

The window security apparatus 11 also includes lock means 31 having a locked position, as clearly shown in FIG. 3 of the drawing and characterized therein merely by the numeral 31, and an unlocked position, as clearly shown in FIG. 4 of the drawing and characterized by the numeral 31'. The lock means 31 is provided for selectively precluding the movement of the guard means 25 when the lock means 31 is in the locked position (FIG. 3) and for enabling the guard means 25 to be moved up and down when the lock means 31 is in the unlocked position 31' (FIG. 4).

The guard means 25 includes a horizontal bar member 33 which has the vertical bar members 27 fixedly attached thereto by suitable means as by welding or the like and depending therefrom as clearly shown in FIG. 1 of the drawings. Also included is track means 25 for engaging and guidingly constraining the horizontal bar member 33 as it slidably moves between the window occluded or security position and the window unobstructed or escape positions. Either end of the horizontal bar member 33 is provided with a shoe element 37 for slidably engaging the track means 35.

The track means 35 includes a pair of vertically disposed channel-like members 39, 41 fixedly attached respectively to the pair of casing elements 19 with the remote ends of the horizontal bar member 33, or more specifically the shoe elements 37 thereof, being received in the channel-like members 39, 41. Thus, the guard means 25 is guidingly constrained in its up and down movement with the movement being in a plane which is parallel to the sash members 21, 23 of the window structure 13. Screws 42 or the like are provided for fixedly attaching the members 39, 41 to the casing elements 19.

The lock means 31 includes a vertically disposed pivot pin member 43 which is fixedly attached to the underneath surface of the sill element 17 in any well known manner, e.g., the pin member 43 may simply be constituted by a wood screw or the like which is threaded into the skill member 17 in a manner well known to those skilled in the art. The pin member 43 is placed adjacent to one of the apertures 29 which is conveniently identified as a locking aperture, ie., the aperture *29b* being identified as the locking aperture which is clearly shown in FIGS. 6 and 7 of the drawing.

The lock means 31 also includes a tab member 45 pivotally attached to the pivot pin member 43. From FIGS. 3 and 4 of the drawing it may clearly be seen that the tab member 45 is free to rotate about the pivot pin member 43. Additionally, a comparison study of FIGS. 3, 4; 6, 7 clearly shows how the rotation of the tab member 45 about the pin member 43 is effective to at least partially obscure the locking aperture *29b,* thus establishing the locked position of the lock means 31. Conversely, the tab member 45 is free to rotate about the pivot pin member 43 so as to unobscure the locking aperture *29b* thus establishing the unlocked position, as at 31', of the lock means 31. Additionally, the lower end of one of the vertical bar members 27, e.g., the vertical bar member *27b,* engages and is restingly supported by the tab member 45 when the lock means 31 is in the locked position.

Figure 2:
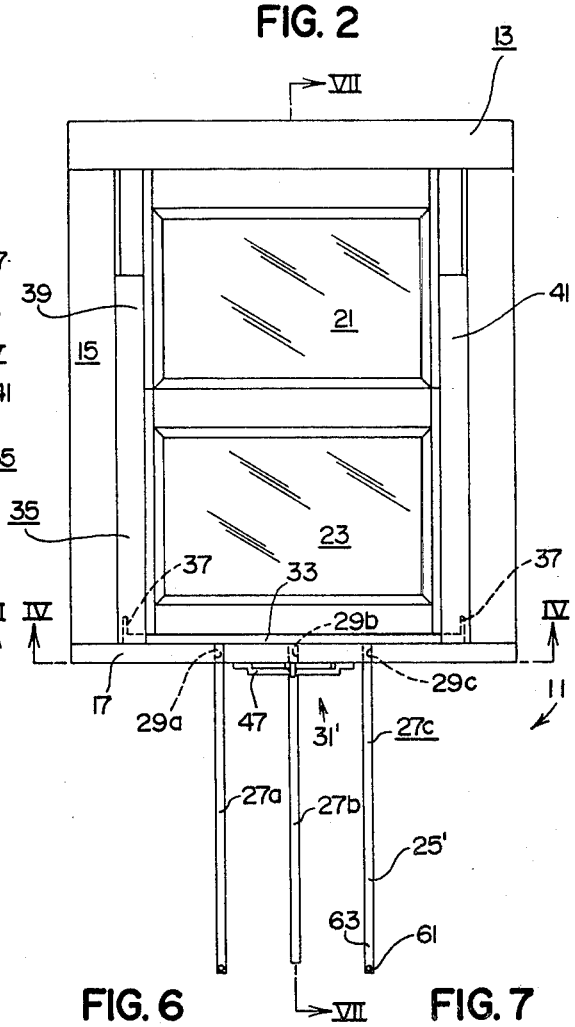
FIG. 2 is a view similar to FIG. 1 with the difference being that the window security apparatus is shown in the downward or escape position.

The lock means 31 preferably includes a tab support member 47 which is fixedly attached to the underneath surface of the still element 17 in underlying relationship with the tab member 45, i.e., the tab support member 47 being offset as shown in FIGS. 1, 2 preferably is fixedly attached to the still element 17 with a plurality of wood screws 49 or the like. The tab support member 47 is provided with a blocking aperture 51 (FIGS. 6, 7) which is aligned with the locking aperture *29b* whereby the blocking aperture 51 is also at least partially obscured by the tab member 45 when the lock means 31 is in the locked position. Placing the lock means 31 in the unlocked position 31' (FIG. 4) is effective in enabling the guard means 25 to be free to gravitate downwardly to the window unobstructed or escape position thereof with one of the vertical bar members, e.g., the bar member *27b,* freely slidably passing through the locking aperture *29b* and the blocking aperture 51 in so doing.

The window security apparatus 11 also includes lock trip/release means 53 for remotely actuating the lock means 31 between the locked and unlocked positions. Applicant anticipates his trip/release means 53 encompassing several embodiments in accordance with the state of the art. In the most simple embodiment the trip/release means 53 includes a lever member 55 fixedly attached to the tab member 45 with the longitudinal axes of the tab member 45 and the lever member 55 being substantially perpendicularly displaced one from the other as clearly shown in FIGS. 3 and 4 of the drawing. The convergence of the longitudinal axes of the tab member 45 and the lever member 55 are substantially coexisting with the vertical axis of the vertically disposed pivot pin member 43.

From the above disclosure it should now be apparent that the concept of the trip/release means 53 is to remotely trip or release the lock means 31 in any feasible but simple manner with the lever member 55 being only one embodiment directed toward that end. The lever member 55 is situated on the interior side 28 of the wall for the residence and since it is inconspicuously positioned beneath the sill element 17 the likelihood of an intruder breaking the window to gain access to the lever 55 is minimal. Also, this would create noise sufficient to arouse the occupants of the residence. Obviously, in the event the lower sash 23 is unlocked or is slightly raised, the effectiveness of the most simple embodiment of the lever 55 is jeopardized since an intruder need only reach through the window to actuate the lever member 55. Of course, the intruder must be in possession of the knowledge (which he may not be) that the lever member 55 is situated beneath the window sill 17. On the other hand, the lever member 55 may be located a distance beyond the reach of the intruder in a manner well known to those skilled in the art, e.g., mechanical linkage or flexible cables (not shown) may be included for interconnecting the remotely situated lever member 55 with the tab member 45 if desired. In either event, the concept is to maintain ultra convenience and simplicity of operation. Thus, this avoids the likelihood of occupants perishing in the room in the event of fire, i.e., due to the malady of frustration or shock precluding clear thinking that may be required in operating more conventional locking devices which depend upon a hidden key or the like to establish an escape route.

The window security apparatus 11 preferably includes stop means 57 for limiting the upward movement of the guard means 25. More specifically, the stop means 57 preferably includes at least one stop pin 59 as clearly shown in FIGS. 2, 3, 4, and 7 of the drawings. At least one of the vertical bar members, e.g., the bar member 27*c*, is provided with a transverse aperture 61 disposed adjacent the lower end thereof, as at 63. The stop pin 59 has a length which exceeds the cross section of the vertical bar member 27*c* and is fixedly received in the transverse aperture 61 in any well known manner e.g. the stop pin 59 preferably is press fitted into the aperture 61. Therefore, the stop pin 59 will not pass upwardly through the aperture 29*c* which is provided in the sill element 17. From FIGS. 2 and 7 of the drawing it may clearly be seen that the vertical bar member 27*c* is slightly longer than the intermediate bar member 27*b*. In other words, any of the vertical bars 27 having the stop means 57 incorporated therewith will preferably be slightly longer than any of the vertical bar members 27 which may be incorporated with the lock means 31. In other words, since any of the vertical bar members which work in conjunction with the lock means 31 must be of sufficient length to be flush with the lower surface of the sill element 17 when the guard means 25 are in the secure position, the vertical bar members which incorporate the stop means 57 would necessarily be longer or protrude a given distance downwardly from the lower surface of the sill element 17 as best shown in FIG. 1 of the drawing.

Although the invention has been described and illustrated with respect to a preferred embodiment thereof, it is to be understood that it is not to be so limited since changes and modifications may be made therein which are within the full intended scope of the invention.

I claim:

1. The combination with residential and such window structure having a frame defined in part by a horizontal sill element and a pair of vertical confrontingly arranged casing elements, of window security apparatus attached to said frame for minimizing the likelihood of intrustion through the window while enabling occupants of the residence to rapidly escape outwardly therethrough in the event of fire and the like, said window security apparatus comprising guard means for providing a security barrier against intrusion into the residence, said guard means including a plurality of rigid, one-piece vertical bar members disposed on the interior side of the window structure, said sill element being provided with a plurality of apertures for respectively slidably receiving said plurality of vertical bar members, said guard means being free to be slidably moved between an up, window occluded position and a down, window unobstructed position independently from any of the window structure, and lock means positioned beneath one of said vertical bar members of said guard means and having locked and unlocked positions for selectively supporting the entire weight of said guard means to preclude downward movement of said guard means when said guard means is in said up, window occluded position and said lock means is in said locked position and for enabling said guard means to be moved up and down when said lock means is in said unlocked position.

2. The combination as set forth in claim 1 in which is included lock trip/release means for remotely actuating said lock means between said locked and unlocked positions.

3. The combination as set forth in claim 1 in which said guard means includes a horizontal bar member having said vertical bar members depending therefrom, and in which is included track means for engaging and guidingly constraining said horizontal bar member as it slidably moves between said window occluded and window unobstructed positions, said track means being separate from the tracks of the window structure that engage and guidingly constrain the sash members of the window structure.

4.

The combination as set forth in claim 3 in which said track means includes a pair of vertically disposed channel-like members fixedly attached respectively to said pair of casing elements with the remote ends of said horizontal bar members being received in said channel-like members, thus said guard means is guidingly constrained in its up and down movement with the movement being in a plane which is parallel to the sash members of said window.

5. Window security apparatus for attachment to the interior side of conventional window structure, said window security apparatus comprising guard means including a horizontally disposed bar member and a plurality of rigid, one-piece vertically disposed bar members having the respective upper ends thereof fixedly attached to said horizontally disposed bar member, the sill element of said window structure being provided with a plurality of apertures for respectively slidably receiving said plurality of vertically disposed bar members, track means fixedly attached to the casing elements of the window structure for engaging and guidingly constraining said horizontally disposed bar member, said track means being separate from the tracks of the window structure that engage and guidingly constrain the sash members of the window structure, said guard means being free to be slidably moved between an up, window occluded position and a down, window unobstructed position independently from either of the sash members of the window structure lock means positioned beneath one of said vertical bar members of said guard means and having locked and unlocked positions for selectively supporting the entire weight of said guard means to preclude downward movement of said guard means when said guard means is in said up, window occluded position and said lock means is in said locked position and for enabling said guard means to be moved up and down when said lock means is in said unlocked position, and lock trip-release means for remotely actuating said lock means between said locked and unlocked positions.

6. The window security apparatus as set forth in claim 5 in which at least one of said plurality of apertures provided in said sill element is identified as a locking aperture and in which said lock means includes a vertically disposed pivot pin member fixedly attached to the underneath surface of the sill element and being adjacent to said locking aperture, a tab member pivotally attached to said pivot pin member, said tab member being free to rotate about said pivot pin member so as to at least partially obscure said locking aperture thus establishing the locked position of said lock means, said tab member being free to rotate about said pivot pin so as to unobscure said locking aperture thus establishing the unlocked position of said lock means, and the lower end of one of said vertical bar members engaging and being restingly supported by said tab member when said lock means is in said locked position.

7. The window security apparatus as set forth in claim 6 in which said lock means includes a tab support member which is fixedly attached to the underneath surface of said sill element in underlying relationship with said tab member, said tab support member being provided with a blocking aperture which is aligned with said locking aperture whereby said blocking aperture is also at least partially obscured by said tab member when said lock means is in said locked position, placing said lock means in said unlocked position is effective in enabling said guard means to be free to gravitate downwardly to said window unobstructed position thereof with said one of said vertical bar members freely slidably passing through said locking and said blocking apertures in so doing.

8. The window security apparatus as set forth in claim 7 in which said lock trip/release means includes a lever fixedly attached to said tab member with the longitudinal axes of said tab member and said lever being substantially perpendicularly displaced one with the other, and the convergence of said longitudinal axes substantially coexisting with the vertical axis of said vertically disposed pivot pin member.

9. The window security apparatus as set forth in claim 5 in which is included stop means for limiting the upward movement of said guard means.

10. The window security apparatus as set forth in claim 9 in which said stop means includes at least one stop pin, at least one of said vertical bar members being provided with a transverse aperture disposed adjacent the lower end thereof, and said stop pin having a length which exceeds the cross section of said vertical bar and being fixedly received in said transverse aperture thus precluding said stop pin from passing upwardly through the appropriate one of said plurality of apertures provided in said sill element.

* * * * *